US006709345B2

(12) United States Patent
Iwata et al.

(10) Patent No.: US 6,709,345 B2
(45) Date of Patent: Mar. 23, 2004

(54) IRON GOLF CLUB AND GOLF CLUB SET

(75) Inventors: Mototaka Iwata, Osaka (JP); Isamu Toshinari, Osaka (JP); Tomomi Watanabe, Osaka (JP); Mamoru Saraie, Osaka (JP)

(73) Assignee: Mizuno Corporation, Osaka (JP)

( * ) Notice: Subject to any disclaimer, the term of this patent is extended or adjusted under 35 U.S.C. 154(b) by 53 days.

(21) Appl. No.: 09/976,496

(22) Filed: Oct. 12, 2001

(65) Prior Publication Data

US 2002/0065140 A1 May 30, 2002

(30) Foreign Application Priority Data

Oct. 16, 2000 (JP) ..... 2000-314678

(51) Int. Cl.[7] ..... A63B 53/04
(52) U.S. Cl. ..... 473/291; 473/350
(58) Field of Search ..... 473/350, 324, 473/349, 290, 291

(56) References Cited

U.S. PATENT DOCUMENTS

| | | | | |
|---|---|---|---|---|
| 4,915,386 A | * | 4/1990 | Antonious | 473/350 |
| 5,282,625 A | | 2/1994 | Schmidt et al. | 273/167 H |
| 5,330,187 A | | 7/1994 | Schmidt et al. | 273/169 |
| 5,333,872 A | * | 8/1994 | Manning et al. | 473/291 |
| 5,413,336 A | | 5/1995 | Iwanaga | 273/77 A |
| 5,749,795 A | * | 5/1998 | Schmidt et al. | 473/350 |
| 5,807,191 A | * | 9/1998 | Nakahara | 473/350 |
| 5,816,936 A | | 10/1998 | Aizawa et al. | |
| 2003/0199331 A1 | * | 10/2003 | Stiles | |

FOREIGN PATENT DOCUMENTS

| | | |
|---|---|---|
| EP | 0 622 095 A1 | 11/1994 |
| GB | 2288984 | 11/1995 |
| GB | 2331249 | 5/1999 |
| JP | 5-27951 | 7/1993 |
| JP | 6-134047 | 5/1994 |
| JP | 6-343722 | 12/1994 |
| JP | 6-343723 | 12/1994 |
| JP | 7-204301 | 8/1995 |
| JP | 3035480 | 3/1997 |
| JP | 10-24130 | 1/1998 |
| JP | 3045407 | 2/1998 |
| JP | 11-47322 A | 2/1999 |
| JP | 11-114109 | 4/1999 |
| JP | 11-178960 | 7/1999 |
| JP | 11-216204 | 8/1999 |
| JP | 3066989 | 3/2000 |
| JP | 2001-212266 | 8/2001 |

* cited by examiner

*Primary Examiner*—Stephen Blau
(74) *Attorney, Agent, or Firm*—Troutman Sanders, LLP; Gerald R. Boss, Esq.

(57) ABSTRACT

A groove is provided a surface on a cavity portion side of a sole portion in a head portion of an iron golf club, and a thickness of a ball hitting portion in a face portion is made larger than a thickness of a top edge side portion of the face portion and at least as large as a thickness of a sole side portion of the face portion. In a golf club set according to the present invention, the groove has the greatest depth in a long iron golf club, while the groove has the smallest depth in a short iron golf club or no groove is provided in the short iron golf club.

6 Claims, 14 Drawing Sheets

IRON GOLF CLUB AND GOLF CLUB SET

This application claims priority from Japanese Patent Application Serial No. 2000-314678 filed Oct. 16, 2000.

BACKGROUND OF THE INVENTION

1. Field of the Invention

The present invention relates to an iron golf club (hereinafter, simply referred to as a "cavity iron") having a cavity portion on the rear surface side of the face portion and a golf club set, and more specifically, to a cavity iron golf club provided on a surface of a sole portion defining the cavity portion with a groove for adjusting a thickness of the face portion while increasing an effective face length and a golf club set having such a golf club.

2. Description of the Background Art

Conventionally, a cavity iron golf club is known in which a sole portion is formed in an undercut-shape in order to achieve weight reduction and to position the centroid position toward the rear side of the face, i.e. deepening the centroid. This type of iron golf club head is disclosed, for instance, in Japanese Utility Model Publication No. 5-27951.

FIG. 23 is a cross sectional view of an iron golf club head disclosed in Japanese Utility Model Publication No. 5-27951.

As shown in FIG. 23, a head portion 1 includes a cavity portion 2, a face portion 3 having a ball hitting surface, and a sole portion 4. An undercut surface 5 is formed by slanting the surface of sole portion 4 defining cavity portion 2. In this manner, by forming undercut surface 5, the centroid depth can be deepened while achieving weight reduction of head portion 1.

In the above document, however, no mention is made of the thickness of face portion 3, and the thickness of face portion 3 is uniform as shown in FIG. 23.

The cavity iron of the type shown in FIG. 23 has excellent directivity of the hit ball, but also has the problem that improvement in carry cannot be achieved.

In addition, since the thickness of face portion 3 is uniform, the cavity iron of FIG. 23 had the problem of significant reduction in the carry in the case of an offset strike where a golf ball is struck at a location other than the sweet spot.

SUMMARY OF THE INVENTION

The present invention is made to solve the above problems. The object of the present invention is to deepen the centroid depth of a golf club head, to increase the moment of inertia in the toe-heel direction, and to improve the directivity of the hit ball while preventing too great a reduction in the carry upon an offset strike in a cavity iron golf club.

An iron golf club according to the present invention is provided with a head portion having a cavity portion, a face portion, and a sole portion, and a groove extending along the face portion is provided on a surface on the cavity portion side of the sole portion, and a thickness of a ball hitting portion in the face portion is made greater than a thickness of a top edge side portion of the face portion located between the ball hitting portion and a top edge portion and at least as thick as a thickness of a sole side portion of the face portion that is located between the ball hitting portion and the sole portion and that extends along the groove.

By providing the groove on the surface on the cavity portion side of the sole portion as described above, an effective face length can be lengthened. Here, the effective face length refers to a length of a portion of the face portion that can flex when hitting a ball, and is a length in the direction from the sole portion toward the top edge portion. By lengthening the effective face length, the face portion becomes more flexible, and thus, the restitution property of the face portion can be improved. Moreover, by making the thickness of the ball hitting portion in the face portion greater than the thickness of the top edge side portion and the thickness of the sole side portion of the face portion, the face portion becomes even more flexible, and the restitution property of the face portion can be effectively improved. Furthermore, by providing the groove, the centroid depth of the golf club head becomes deeper, so that the moment of inertia can be increased and the directivity of the hit ball can be improved.

The thickness of the ball hitting portion is made greater than a thickness of a toe side portion of the face portion located between a toe portion of the head portion and the ball hitting portion and greater than a thickness of a heel side portion of the face portion located between a heel portion of the head portion and the ball hitting portion. In this case, also, the face portion can be made more flexible and the restitution property of the face portion can be improved. In addition, formation by forging is preferable in order to make the thickness thin while maintaining strength in the toe side portion and the heel side portion.

The toe side portion includes a first region located on the top edge portion side and a second region located on the sole portion side, and the heel side portion includes a third region located on the top edge portion side and a fourth region located on the sole portion side. In this case, a thickness of the first region is preferably made smaller than a thickness of the second region, and a thickness of the third region is preferably made smaller than a thickness of the fourth region. Thus, the face portion can be made even more flexible and the restitution property of the face portion can be improved.

Preferably, the height of a base surface of the groove from a base surface of the sole portion is made lower on the heel portion side than on the toe portion side.

Normally, the height of the face of the iron golf club head is made higher on the toe portion side and lower on the heel portion side. By making the height of the base surface of the groove from the base surface of the sole portion lower on the heel portion side than on the toe portion side, the effective face length can be lengthened on the heel portion side as well. Consequently, the effective face lengths can be made equal on the toe portion side and the heel portion side so that the restitution property can be improved even when a ball is struck on the toe portion side or on the heel portion side in the case of the offset strike.

The sole portion includes a projected wall portion that defines one of side walls of the groove and that rises along the face portion toward the top edge portion. This projected wall portion has a trapezoid-like shape, for instance.

As described above, by providing the projected wall portion behind the face portion, the centroid depth can be deepened and the directivity of the hit ball can be improved.

A through hole is provided in the sole portion such that it reaches the cavity portion from the base surface of the sole portion, and the groove may be provided by attaching a blocking member that closes an end portion on the base surface side of the sole portion in the through hole. Thus, a deep groove can be formed in the sole portion along the face portion, and the effective face length can be lengthened.

The specific gravity of a material composing the blocking member is preferably made greater than the specific gravity of a material composing a head portion body. Thus, the centroid position of the golf club head can be lowered.

A back side portion located behind the face portion in the head portion may be formed by a back part which is a separate member from the head portion body. In this case, by attaching the back part to the head portion body, the groove is provided between the head portion body and the back part. In this manner, by making the back side portion of the head portion a separate member from the head portion body, a deep groove can be formed in the sole portion along the face portion and the effective face length can be lengthened, as in the case where the through hole is provided as described above.

The specific gravity of a material composing the back part is preferably made greater than the specific gravity of a material composing the head portion body. Thus, the centroid depth of the golf club head can be made deeper, while lowering the centroid position.

In one aspect, a golf club set according to the present invention includes a long iron golf club (for instance, No. 1 to No. 4 iron golf clubs), a middle iron golf club (for instance, No. 5 to No. 7 iron golf clubs), and a short iron golf club (for instance, No. 8 iron golf club to a sand wedge). Each of the long iron golf club, the middle iron golf club, and the short iron golf club is provided with a head portion having a cavity portion, a face portion, and a sole portion, and is provided with a groove extending along the face portion on a surface on the cavity portion side of the sole portion. The depth of the groove in a center portion of the face portion of the long iron golf club is greater than the depth of the groove in a center portion of the face portion of the middle iron golf club, and the depth of the groove in the center portion of the face portion of the middle iron golf club is greater than the depth of the groove in a center portion of the face portion of the short iron golf club.

As described above, by gradually making the depth of the groove provided in the sole portion deeper from a short iron golf club toward a long iron golf club, greater increase in the effective face length and thus higher restitution property can be achieved toward the long iron golf club of which long carry is demanded, and a golf club set whose emphasis is on improved carry can be provided.

In another aspect of the golf club set according to the present invention, a groove extending along the face portion is provided on a surface on the cavity portion side of the sole portion of each of the long iron golf club and the middle iron golf club, and the depth of the groove in a center portion of the face portion of the long iron golf club is made greater than the depth of the groove in a center portion of the face portion of the middle iron golf club, while the groove extending along the face portion is not provided on a surface on the cavity portion side of the sole portion of the short iron golf club. In this case, also, the same effects as those obtained in the above-described one aspect can be achieved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
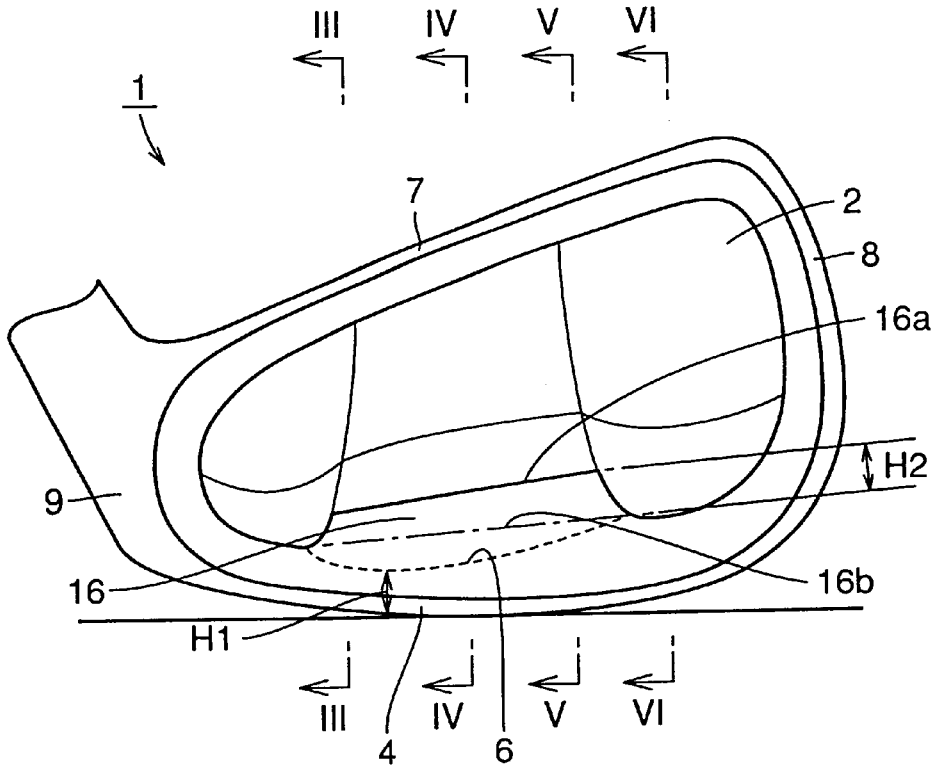
FIG. 1 is a diagram of a head portion of an iron golf club according to the present invention viewed from a rear surface side of a face.
Figure 2:
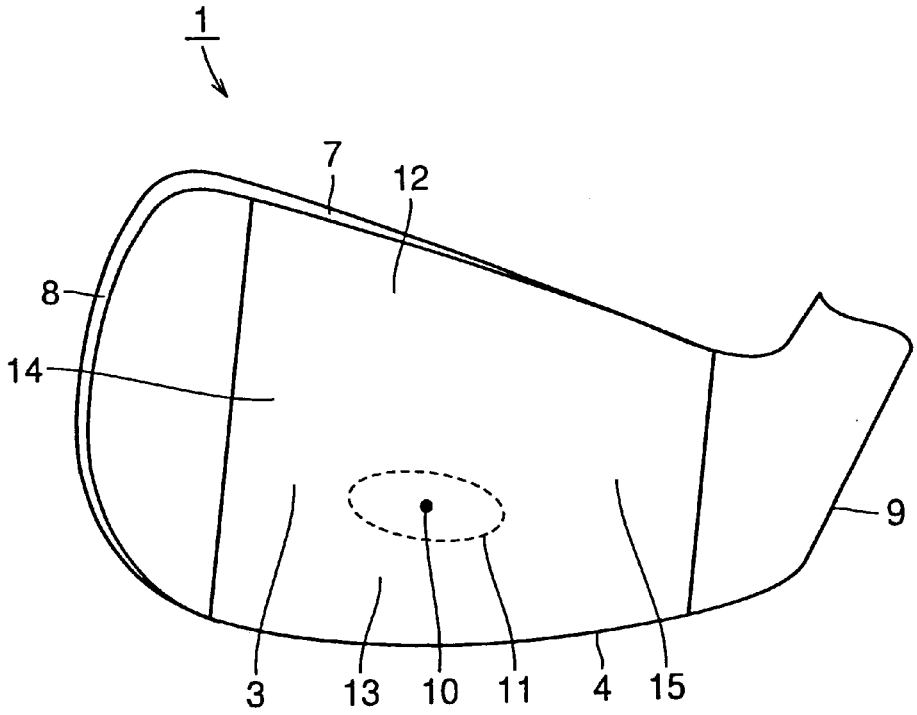
FIG. 2 is a diagram of the head portion of the iron golf club according to the present invention viewed from a face surface side.

The embodiments of the present invention will be described below with reference to FIGS. 1 to 21. FIG. 1 is a rear view of a head portion 1 of a No. 5 iron golf club (middle iron golf club) according to the present invention viewed from a rear surface side of a face. FIG. 2 is a front view of head portion 1 viewed from a face surface (ball hitting surface) side. A shaft and a grip are not shown in FIGS. 1 and 2.

As shown in FIGS. 1 and 2, head portion 1 is provided with a cavity portion 2, a face portion 3, a sole portion 4, a groove 6, a top edge portion 7, a toe portion 8, a heel portion 9, and a projected wall portion 16.

Head portion 1 can be formed by forging and machining a soft steel member, for instance. Cavity portion 2 is provided on a rear surface side of face portion 3. By providing cavity portion 2, head portion 1 can be made lighter in weight.

As shown in FIG. 2, face portion 3 includes a ball hitting portion 11, a top edge side portion 12, a sole side portion 13, a toe side portion 14, and a heel side portion 15.

Ball hitting portion 11 is a portion of high restitution (for instance, having a coefficient of restitution of 0.9 or greater) which is mainly expected to hit a ball, and includes a sweet spot 10 and its surrounding region.

Now, a method of measuring the coefficient of restitution will be described.

First, the face surface of an iron golf club head is held vertically to the ground and to a golf ball with which it makes the impact. The golf ball is caused to impact a center of a score line of the golf club or its sweet spot position, and a ball speed Vin before the impact (Vin=44±0.5 m/s in the present testing method) and a ball speed Vout after the impact are measured using a speed meter having an optical sensor. Using the measured Vin and Vout and the following formula (1), a coefficient of restitution COR is calculated.

$$Vout/Vin=(COR\times M-m)/(M+m) \quad (1)$$

Here, M is the mass of the iron head, and m is the mass of the golf ball. As a golf ball, Pinnacle Gold LS commercially available from Acushinet Company is used. An average weight of the golf balls is 45.4±0.4 grams, and during the test, the golf balls are kept in a room maintained at 23±1° C.

The thickness of face portion 3 in ball hitting portion 11 is 3.7 mm, for instance.

Top edge side portion 12 is located between ball hitting portion 11 and top edge portion 7. The thickness of face portion 3 in top edge side portion 12 is 3 mm, for instance. Thus, the thickness of ball hitting portion 11 is greater than the thickness of top edge side portion 12.

Sole side portion 13 is located between ball hitting portion 11 and sole portion 4. The thickness of face portion 3 in sole side portion 13 is 3.1 mm, for instance. Thus, the thickness of ball hitting portion 11 is greater than the thickness of sole side portion 13.

By making the thickness of ball hitting portion 11 greater than the thickness of top edge side portion 12 and the thickness of sole side portion 13 as described above, face portion 3 can be made flexible, and the restitution property of face portion 3 can be improved.

Toe side portion 14 is located between ball hitting portion 11 and toe portion 8. The thickness of face portion 3 in toe side portion 14 is 2.5 mm to 3.0 mm, for instance. Toe side portion 14 includes a first region located on top edge portion 7 side and a second region located on sole portion 4 side. The thickness of the first region is 2.5 mm, for instance, and the thickness of the second region is 3.0 mm, for instance.

Heel side portion 15 is located between ball hitting portion 11 and heel portion 9. The thickness of face portion 3 in heel side portion 15 is 2.5 mm to 3.0 mm, for instance. Heel side portion 15 includes a third region located on top edge portion 7 side and a fourth region located on sole portion 4 side. The thickness of the third region is 2.5 mm, for instance, and the thickness of the fourth region is 3.0 mm, for instance.

By making the thickness of ball hitting portion 11 greater than the thickness of toe side portion 14 and the thickness of heel side portion 15 as described above, face portion 3 can be made even more flexible. This also can contribute effectively to the improvement of the restitution property of face portion 3.

Sole portion 4 has groove 6 as shown in FIG. 1. FIGS. 3 to 6 respectively show the cross sectional views taken along a line III—III, a line IV—IV, a line V—V, and a line VI—VI of head portion 1 shown in FIG. 1.

Groove 6 can be formed by machining (cutting) a surface on cavity portion 2 side in sole portion 4. For instance, the cutting edge angle for machining relative the face surface is set to 5 to 6 degrees, for instance, and the cutting is performed from a surface of sole portion 4 along a line C—C shown in FIG. 3 to form groove 6 having a width of about 6 mm.

Groove 6 extends in a direction from toe portion 8 toward heel portion 9 as shown in FIG. 1, and a base surface of groove 6 is closer to a base surface of sole portion 4 on heel portion 9 side than on toe portion 8 side. Thus, a height H from a point of contact that sole portion 4 makes with the ground when addressing the iron golf club to a base surface of groove 6 is lower on heel portion 9 side than on toe portion 8 side, and a minimum height H1 of the base surface of groove 6 is located toward heel portion 9 side from a face center portion in the direction from toe portion 8 toward heel portion 9.

Height H of the base surface of groove 6 changes in the direction from toe portion 8 toward heel portion 9. In the cross section of FIG. 3, height H of the base surface of groove 6 is 11 mm, and a depth D of groove 6 is about 8 mm. In the cross section of FIG. 4, height H of the base surface of groove 6 is 13 mm, and depth D of groove 6 is about 7 mm. In the cross section of FIG. 5, height H of the base surface of groove 6 is 13.5 mm, and depth D of groove 6 is about 6.5 mm. In the cross section of FIG. 6, height H of the base surface of groove 6 is 16 mm, and depth D of groove 6 is about 1 mm. Thus, depth D of groove 6 becomes deeper on heel portion 9 side than on toe portion 8 side.

By providing groove 6 as described above, effective face lengths L1 to L4 can be lengthened, as shown in FIGS. 3 to 6.

Specifically, an effective face length L1 on heel portion 9 side is 24 mm, for instance, an effective face length L2 in the face center portion is 27 mm, for instance, an effective face length L3 is 31 mm, for instance, and an effective face length L4 on toe portion 8 side is 32 mm, for instance.

In this manner, effective face lengths L1 to L4 can be lengthened so that face portion 3 can be made even more flexible, and the restitution property of face portion 3 can be improved.

Figure 3:
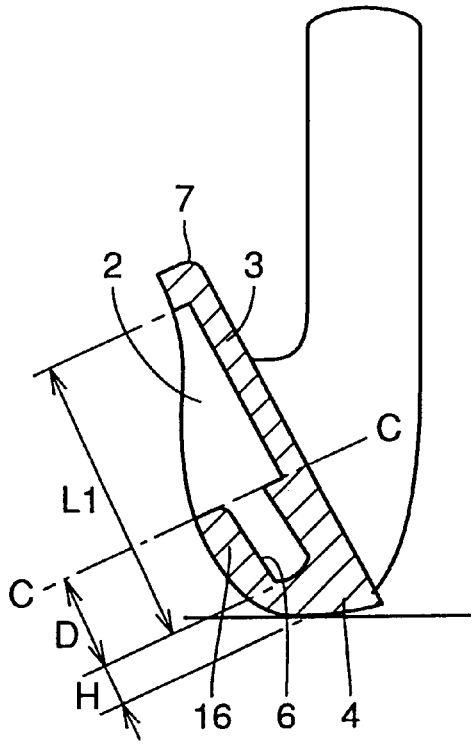
FIG. 3 is a cross sectional view taken along a line III—III in FIG. 1.
Figure 4:
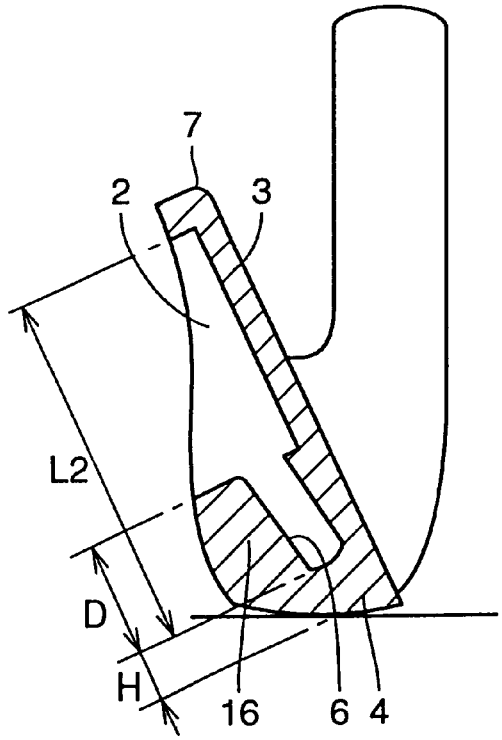
FIG. 4 is a cross sectional view taken along a line IV—IV in FIG. 1.
Figure 5:
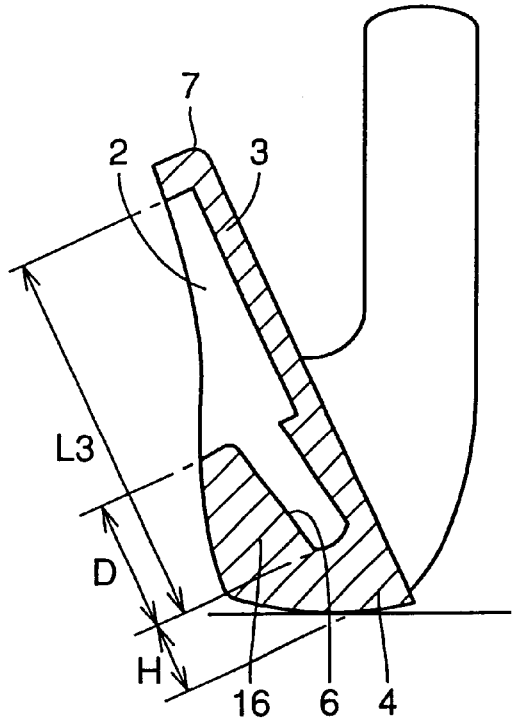
FIG. 5 is a cross sectional view taken along a line V—V in FIG. 1.
Figure 6:
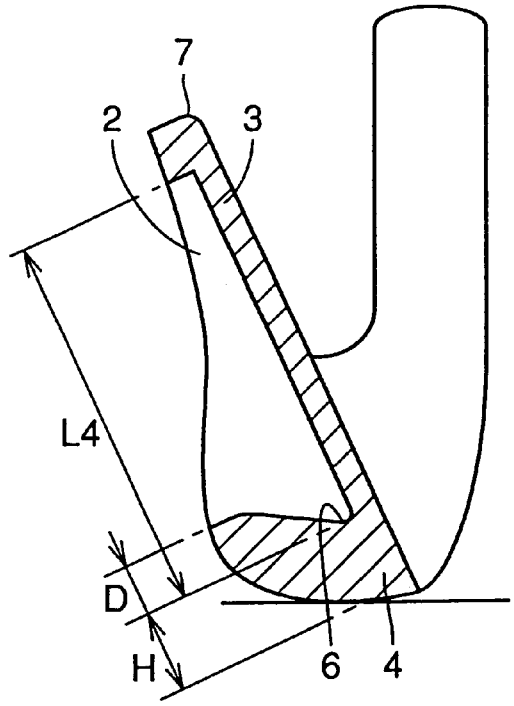
FIG. 6 is a cross sectional view taken along a line VI—VI in FIG. 1.

As shown in FIG. 3 and so on, projected wall portion 16 defines one of side walls of groove 6 and rises along face portion 3 toward top edge portion 7. Projected wall portion 16 has a trapezoid-like shape, as shown in FIG. 1.

In addition, another embodiment of a No. 5 iron golf club will be described with reference to FIGS. 1, 2, and 7 to 10. The thickness of a face portion 3 in a ball hitting portion 11 of this iron golf club is 4.3 mm, for instance. A top edge side portion 12 is located between ball hitting portion 11 and a top edge portion 7. The thickness of face portion 3 in top edge side portion 12 is 3.3 mm, for instance. Thus, the thickness of ball hitting portion 11 is greater than the thickness of top edge side portion 12.

A sole side portion 13 is located between ball hitting portion 11 and a sole portion 4. The thickness of face portion 3 in sole side portion 13 is 4.3 mm, for instance. Thus, the thickness of ball hitting portion 11 is the same as the thickness of sole side portion 13.

By making the thickness of ball hitting portion 11 greater than the thickness of top edge side portion 12 as described above, face portion 3 can be made flexible, and the restitution property of face portion 3 can be improved.

A toe side portion 14 is located between ball hitting portion 11 and a toe portion 8. The thickness of face portion 3 in toe side portion 14 is 2.8 mm to 3.3 mm, for instance. Toe side portion 14 includes a first region located on top edge portion 7 side and a second region located on sole portion 4 side. The thickness of the first region is 2.8 mm, for instance, and the thickness of the second region is 3.3 mm, for instance.

A heel side portion 15 is located between ball hitting portion 11 and a heel portion 9. The thickness of face portion 3 in heel side portion 15 is 2.8 mm to 3.3 mm, for instance. Heel side portion 15 includes a third region located on top edge portion 7 side and a fourth region located on sole portion 4 side. The thickness of the third region is 2.8 mm, for instance, and the thickness of the fourth region is 3.3 mm, for instance.

By making the thickness of ball hitting portion 11 greater than the thickness of toe side portion 14 and the thickness of heel side portion 15 as described above, face portion 3 can be made even more flexible. This also can contribute effectively to the improvement of the restitution property of face portion 3.

Sole portion 4 has groove 6 as shown in FIG. 1. FIGS. 7 to 10 respectively show the cross sectional views taken along a line III—III, a line IV—IV, a line V—V, and a line VI—VI of head portion 1 shown in FIG. 1.

Groove 6 can be formed by machining (cutting) a surface on a cavity portion 2 side in sole portion 4. According to this embodiment, the cutting edge angle for machining relative to the face surface is set to 0 degree so as to make groove 6 parallel to the face surface, and the cutting is performed from a surface of sole portion 4 along a line CC—CC shown in FIG. 7 to form groove 6 having a width of about 6 mm.

Groove 6 extends in a direction from toe portion 8 toward heel portion 9 as shown in FIG. 1, and a base surface of groove 6 is closer to a base surface of sole portion 4 on heel portion 9 side than on toe portion 8 side. Thus, a height H from a point of contact that sole portion 4 makes with the ground when addressing the iron golf club to a base surface of groove 6 is lower on heel portion 9 side than on toe portion 8 side, and a minimum height Hi of the base surface of groove 6 is located toward heel portion 9 side from a face center portion in the direction from toe portion 8 toward heel portion 9.

Height H of the base surface of groove 6 changes in the direction from toe portion 8 toward heel portion 9. In the cross section of FIG. 7, height H of the base surface of groove 6 is 11 mm, and a depth D of groove 6 is about 8 mm. In the cross section of FIG. 8, height H of the base surface of groove 6 is 13 mm, and depth D of groove 6 is about 7 mm. In the cross section of FIG. 9, height H of the base surface of groove 6 is 13.5 mm, and depth D of groove 6 is about 6.5 mm. In the cross section of FIG. 10, height H of the base surface of groove 6 is 16 mm, and depth D of groove 6 is about 1 mm. Thus, depth D of groove 6 becomes deeper on heel portion 9 side than on toe portion 8 side.

By providing groove 6 as described above, effective face lengths L5 to L8 can be lengthened, as shown in FIGS. 7 to 10.

Specifically, an effective face length L5 on heel portion 9 side is 24 mm, for instance, an effective face length L6 in the face center portion is 27 mm, for instance, an effective face length L7 is 31 mm, for instance, and an effective face length L8 on toe portion 8 side is 32 mm, for instance.

In this manner, effective face lengths L5 to L8 can be lengthened so that face portion 3 can be made even more flexible, and the restitution property of face portion 3 can be improved.

Figure 7:
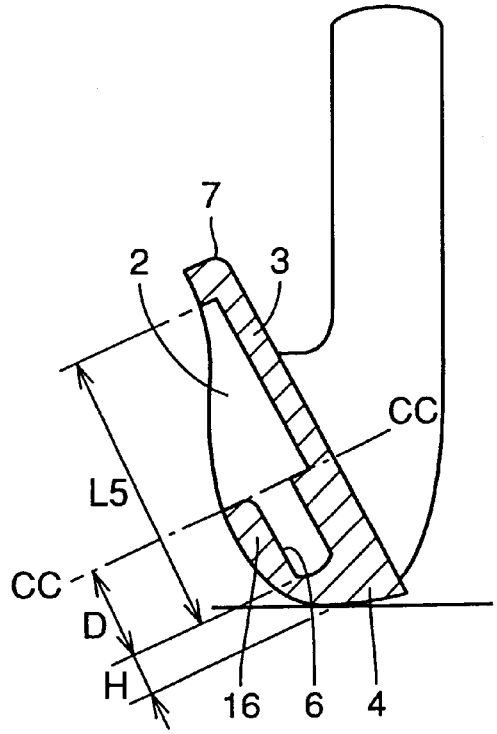
FIG. 7 is a cross sectional view of another embodiment taken along a line III—III in FIG. 1.
Figure 8:
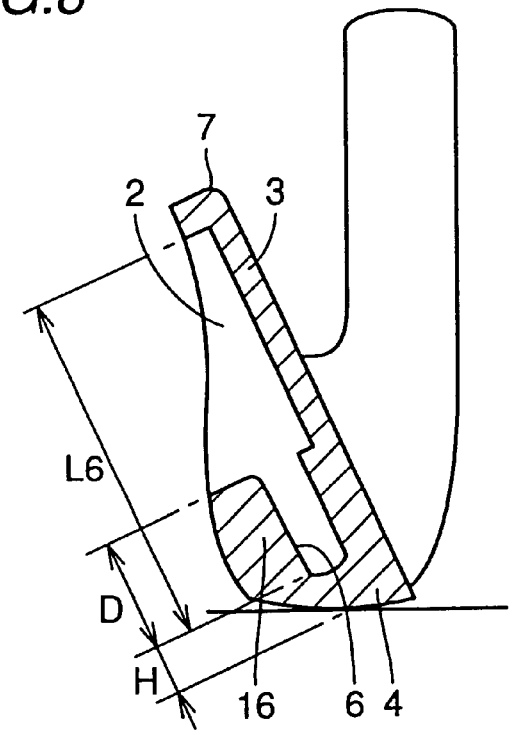
FIG. 8 is a cross sectional view of another embodiment taken along a line IV—IV in FIG. 1.
Figure 9:
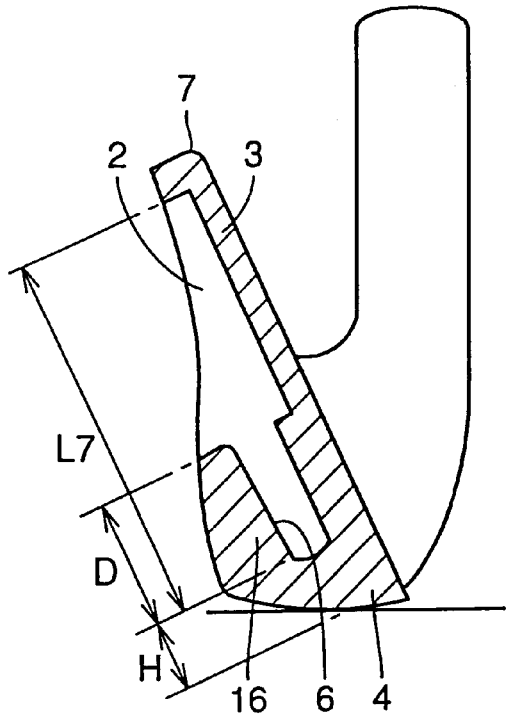
FIG. 9 is a cross sectional view of another embodiment taken along a line V—V in FIG. 1.
Figure 10:
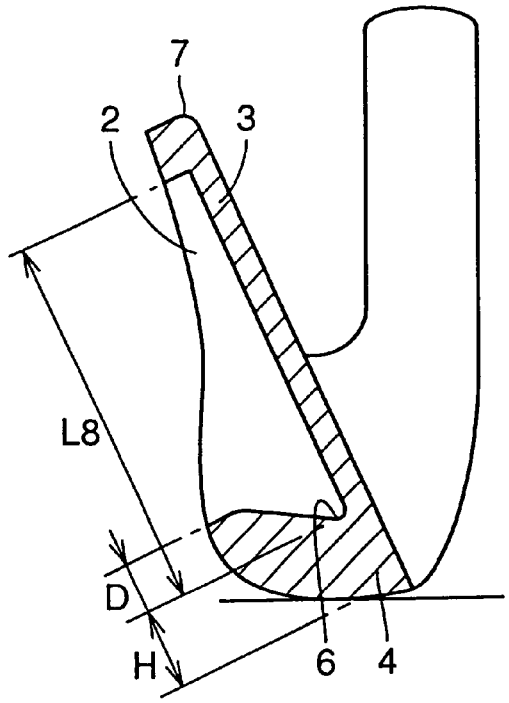
FIG. 10 is a cross sectional view of another embodiment taken along a line VI—VI in FIG. 1.

As shown in FIG. 7 and so on, projected wall portion 16 defines one of side walls of groove 6 and rises along face portion 3 toward top edge portion 7. Projected wall portion 16 has a trapezoid-like shape, as shown in FIG. 1.

Like the above-described embodiment, by providing projected wall portion 16 behind face portion 3, the centroid depth of head portion 1 can be deepened, and the directivity of the hit ball can be improved.

Now, the measured results of the coefficient of restitution, the centroid depth, and the moment of inertia in the toe-heel direction of each of the above-described embodiment of the present invention and a conventional cavity iron golf club are shown in Table 1.

TABLE 1

| | Coefficient of restitution | Centroid depth (mm) | Moment of inertia in toe-heel direction ($g \cdot cm^2$) |
|---|---|---|---|
| Inventive product | 0.805 | 4.0 | 2650 |
| Conventional product | 0.765 | 2.7 | 2500 |

As shown above, the inventive product has a higher coefficient of restitution and greater centroid depth and moment of inertia in the toe-heel direction than the conventional product. Thus, the inventive product can offer improved directivity of the hit ball as well as improved restitution property.

Now, another example of a cavity iron golf club according to the present invention will be described with reference to FIGS. 11 to 16.

Figure 11:
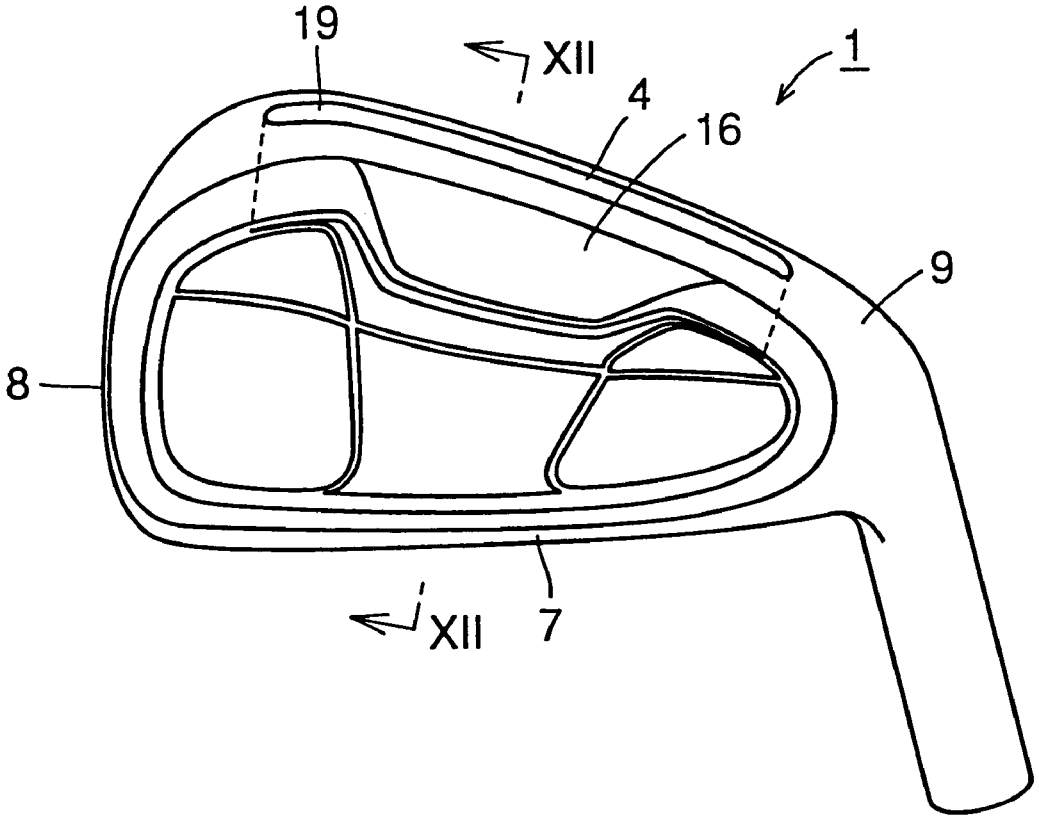
FIG. 11 is a rear view of a head portion of a cavity iron golf club of another example according to the present invention.
Figure 12:
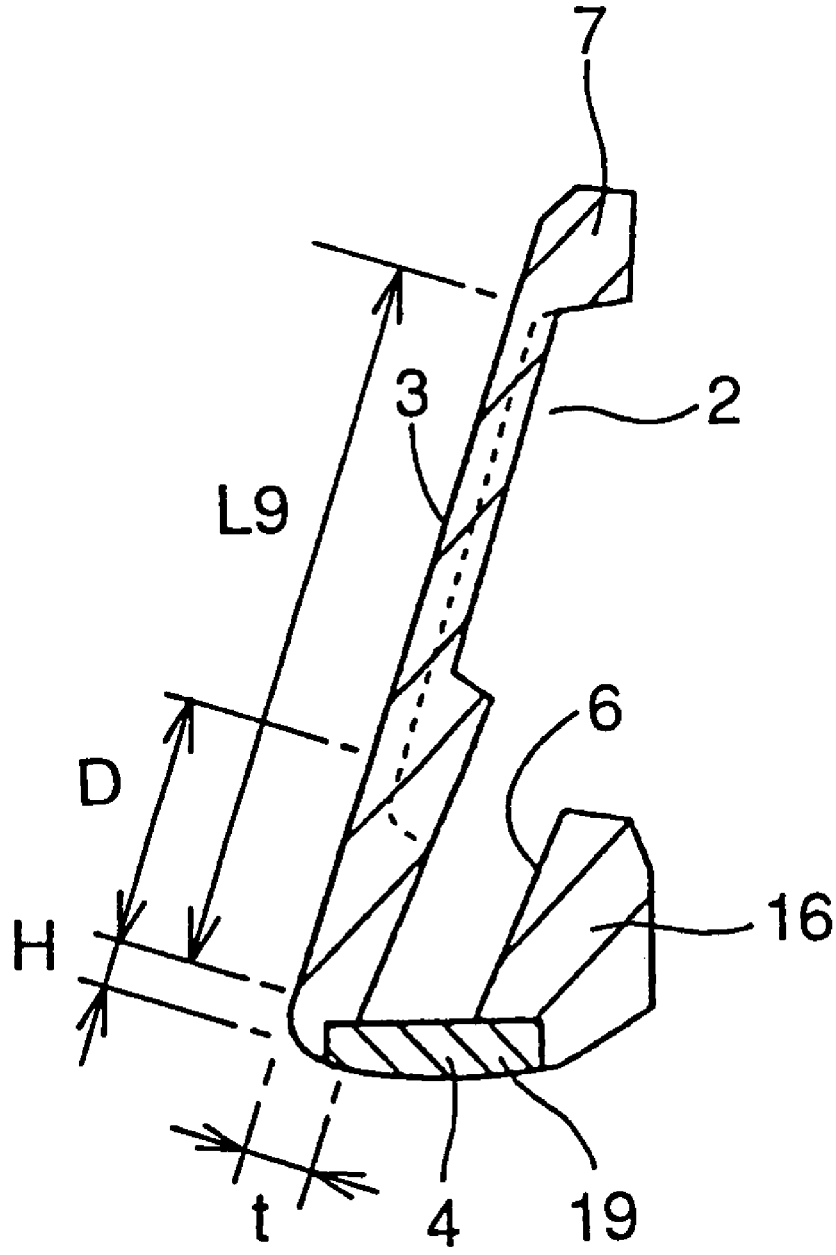
FIG. 12 is a cross sectional view taken along a line XII—XII in FIG. 11.
Figure 13:
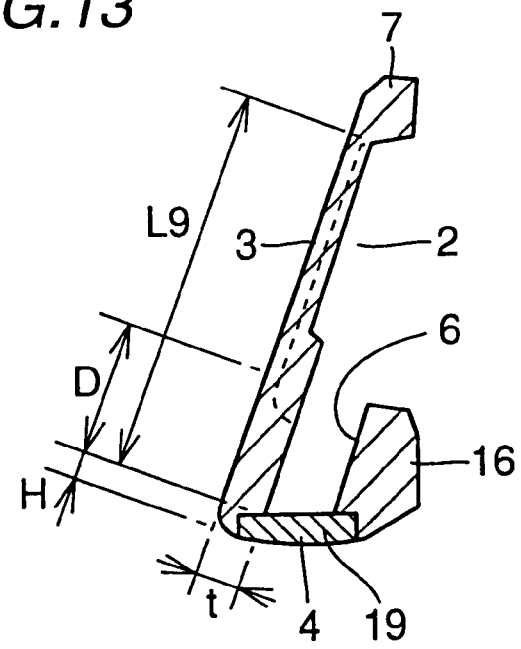
FIG. 13 is a cross sectional view taken along the line XII—XII of a modification of the example shown in FIG. 11.

FIG. 11 is a rear view of a head portion 1 of a No. 5 cavity iron golf club of another example according to the present invention, and FIGS. 12 and 13 are cross sectional views taken along a line XII—XII in FIG. 11.

As shown in FIGS. 12 and 13, according to this example, a through hole that reaches a base surface of a sole portion 4 from a cavity portion 2 is formed in sole portion 4, and a tungsten plate (blocking member) 19 is press-fitted and fixed to an end portion on the base surface side of sole portion 4 in the through hole, thereby forming a groove (undercut portion) 6 on the rear surface side of a face portion 3. A base surface of groove 6 is defined by tungsten plate 19.

While an example shown in FIG. 12 is one in which the through hole is formed with a slope relative to a ball hitting surface of face portion 3, an example shown in FIG. 13 is one in which the through hole is formed in parallel to the ball hitting surface of face portion 3. In addition, the relation between a thickness of a ball hitting portion in face portion 3 and a thickness in a region other than the ball hitting portion in face portion 3 shown in FIGS. 12 and 13 is the same as that of the case shown in FIG. 1 and so on described above.

By forming a through hole as described above and forming groove 6 by fitting tungsten plate 19 into sole portion 4, a depth D of groove 6 can be made greater than that in the above-described example. Specifically, depth D of groove 6 can be made to be approximately 9 mm (heel portion) to 15 mm (toe portion).

At this time, a height H from a point of contact that sole portion 4 makes with the ground when addressing an iron golf club to a base surface of groove 6 becomes approximately 3 mm (heel portion) to 4 mm (toe portion), and an effective face length L9 becomes approximately 26 mm (heel portion) to 38 mm (toe portion).

Thus, effective face length L9 can be made longer than the above-described example, face portion 3 can be made even more flexible, and the restitution property of face portion 3 can be improved.

In addition, the distribution of depth D of groove 6 from toe portion 8 to heel portion 9 can be made similar to that of the above-described embodiments. Moreover, by fitting a member with a large specific gravity such as tungsten plate 19 described above to sole portion 4, the centroid position of head portion 1 can be lowered. A member other than tungsten plate 19, as long as it is made of a material having a specific gravity that is greater than that of the material of the head portion 1 body, can be used in place of tungsten plate 19.

Now, a manufacturing method of the example shown in FIG. 13 will be described with reference to FIGS. 14 to 16.

Figure 14:
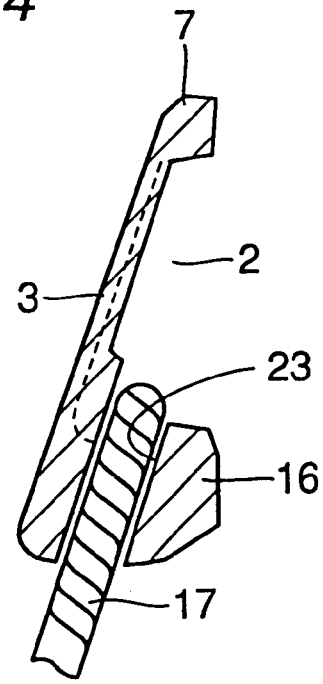
FIGS. 14 to 16 are cross sectional views respectively showing the first to third steps in the manufacturing steps of a head portion of an iron golf club shown in FIG. 13.

As shown in FIG. 14, a through hole 23 of a prescribed length is formed in sole portion 4 by machining using a ball end mill 17. Through hole 23 is a slot or elongate hole that reaches a base surface of sole portion 4 from cavity portion 2 along face portion 3 and that extends from toe portion 8 toward heel portion 9 of head portion 1.

Figure 15:
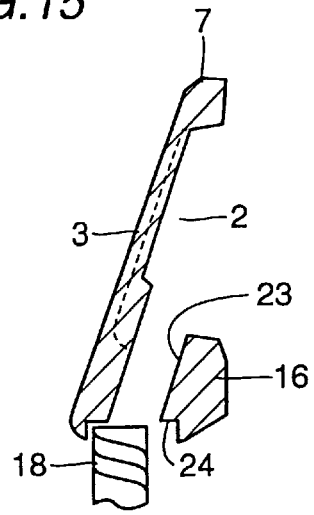
Figure 16:
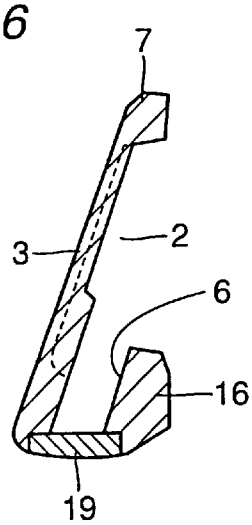

Then, as shown in FIG. 15, a step portion 24 is formed by cutting the base surface of sole portion 4 around through hole 23 using an end mill 18. Tungsten plate 19 is press-fitted onto step portion 24 as shown in FIG. 16. Thus, the end portion on the base surface side of sole portion 4 in through hole 23 can be blocked with tungsten plate 19, while groove 6 can be formed on the back side of head portion 1.

Now, a modification of the example shown in FIG. 13 will be described using FIG. 17.

Figure 17:
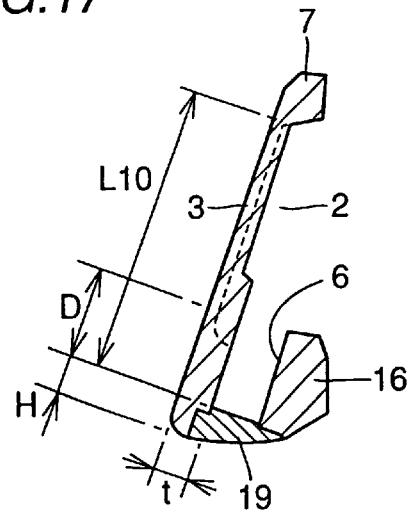
FIG. 17 is a cross sectional view of a modification of the head portion shown in FIG. 13.

In this modification, as shown in FIG. 17, the shape of a tungsten plate 19 is varied from that of the example shown in FIG. 13. Specifically, as shown in FIG. 17, the thickness of tungsten plate 19 on face portion 3 side is made greater than its thickness on projected wall portion 16 side. Consequently, the centroid position of head portion 1 can be more effectively lowered.

A depth D of groove 6 in this example is approximately 7 mm (heel portion) to 13 mm (toe portion), a height H from a point of contact that sole portion 4 makes with the ground when addressing an iron golf club to a base surface of groove 6 becomes approximately 3 mm (heel portion) to 5 mm (toe portion), and an effective face length L10 becomes approximately 24 mm (heel portion) to 36 mm (toe portion).

The arrangement in portions other than that described above is substantially the same as that in the example shown in FIG. 13. Thus, the effects equivalent to those achieved by the example shown in FIG. 13 can be obtained.

Figure 18:
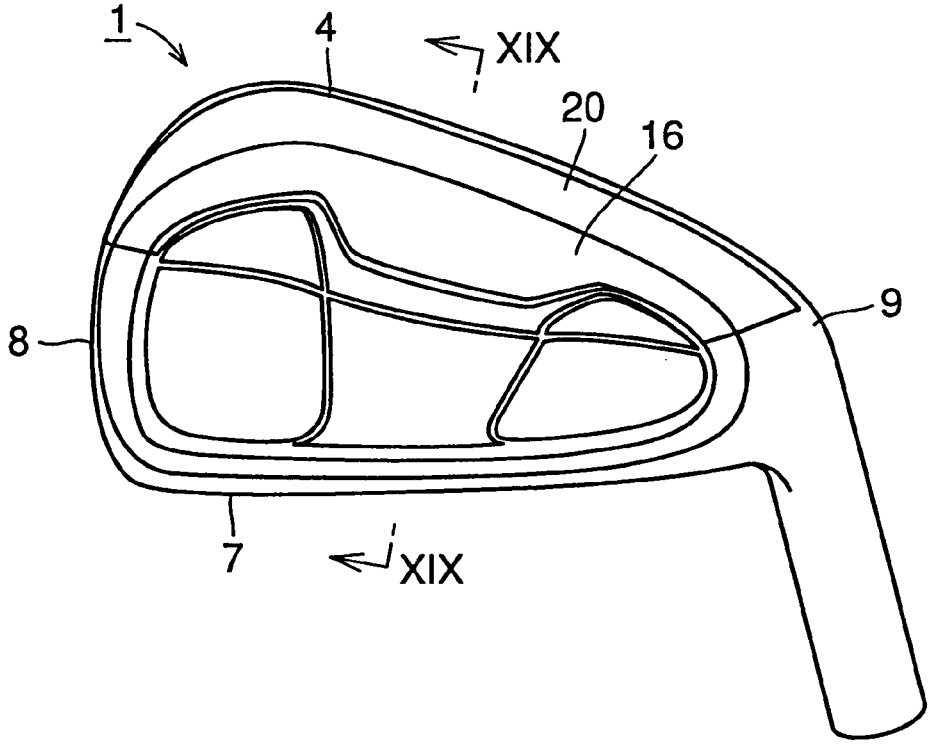
FIG. 18 is a rear view of a head portion of a cavity iron golf club of a further example according to the present invention.
Figure 19:
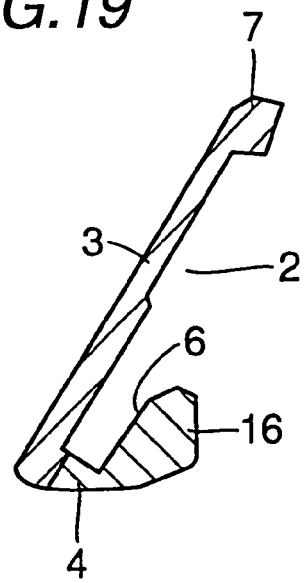
FIG. 19 is a cross sectional view taken along a line XIX—XIX in FIG. 18.
Figure 20:
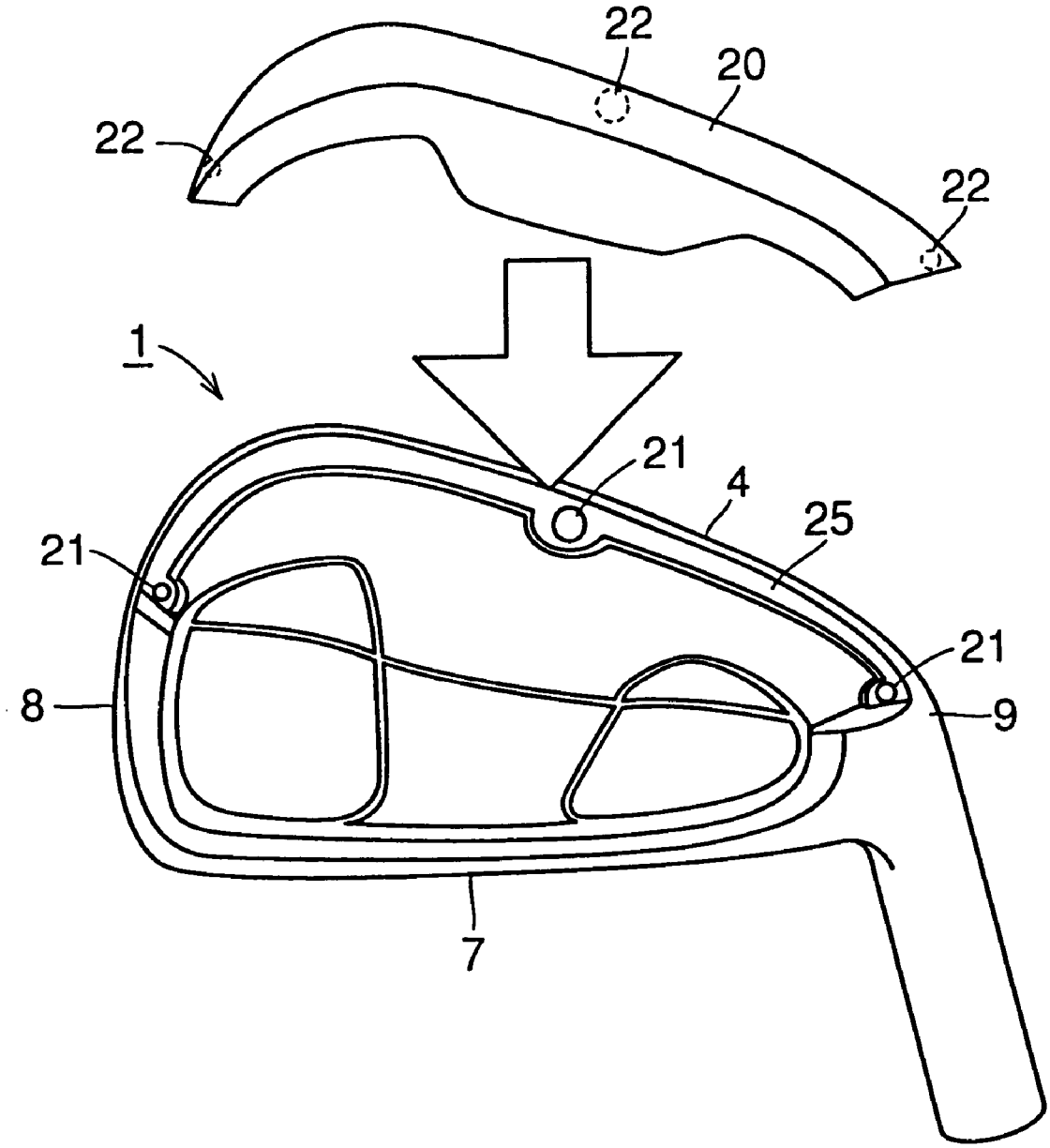
FIG. 20 is a diagram related to a description of a method of manufacturing a head portion shown in FIG. 18.

Now, a further example according to the present invention will be described with reference to FIGS. 18 to 20. FIG. 18 is a rear view of a head portion 1 of a cavity iron golf club of a further example according to the present invention, and FIG. 19 is a cross sectional view taken along a line XIX—XIX in FIG. 18.

As shown in FIG. 18, in this example, a back part 20 is attached to the head portion 1 body. Back part 20 forms a portion of a sole portion 4 as well as a projected wall portion 16 behind a face portion 3.

As a material for the head portion 1 body, any material that can be formed by forging, such as soft steel, stainless steel, and other iron-based alloy materials, aluminum, an aluminum alloy, titanium, a titanium alloy, a magnesium alloy and the like, can be used.

As a material for back part 20, it is preferable to select a material having a larger specific gravity than that of the material for the head portion 1 body. For instance, if the material of the head portion 1 body is aluminum, an aluminum alloy, titanium, or a titanium alloy, then soft steel, a stainless steel alloy, a copper alloy, a cobalt alloy, a tungsten alloy, a nickel alloy and the like may be used as the material of back part 20, and if the material of the head portion 1 body is an iron-based alloy material such as soft steel and stainless steel, then a copper-based alloy, a tungsten alloy and the like may be used as the material of back part 20.

As described above, by attaching back part 20 to the head portion 1 body, as shown in FIG. 19, a groove portion (undercut portion) 6 can be formed behind face portion 3, and the effective face length can be made longer as in the case of each of the examples described above. Thus, the restitution property of face portion 3 can be improved.

In addition, by selecting as a material for back part 20 a material having a specific gravity greater than that of the material of the head portion 1 body, the centroid depth of head portion 1 can be made deeper, while lowering the centroid position of head portion 1.

Moreover, attaching back part 20 to the head portion 1 body also offers the following advantages.

Although a cavity of a significant size can be formed in an iron golf club head produced by casting, there is a disadvantage in that this head provides inferior shot feel when compared with the head produced by forging.

On the other hand, it is difficult to form a large undercut cavity by machining in the head portion 1 body formed by forging. Particularly, in an iron head having a large loft angle, it is difficult to increase the cavity area by machining from inside the cavity. In addition, normally, there is a portion that is projected backward in the vicinity of the top edge on the back side of an iron head so that there is a limit to the depth that can be achieved by cutting in terms of the angle using a straight cutting blade, and even when a cutting blade having a special shape such as a T slot cutter is to be employed, there naturally is a limit to the depth that can be achieved by cutting due to the restriction of the size of the cavity opening and such.

By attaching back part 20 to the head portion 1 body as described above, however, the undercut cavity of a desired size can be formed behind the head portion 1 body even when the head portion 1 body is formed by forging. As a consequence, head portion 1 that offers excellent shot feel and that has a great centroid depth and a low centroid position can be provided.

In addition, with the iron head according to the present invention, a deep undercut portion can be seen from the outside, and the fact that back part 20 utilizes a different kind of material from that of the head portion 1 body can also be perceived from the outside so that a user can play golf while objectively apprehending the performance of the iron head according to the present invention.

Moreover, in this example, the depth and the shape of groove 6, the height from a point of contact that sole portion 4 makes with the ground when addressing the iron golf club to a base surface of groove 6, and the effective face length can be similar to those in the example shown in FIG. 13 or in the example shown in FIG. 17.

In addition, it is also possible to make the depth distribution of groove 6 from toe portion 8 to heel portion 9 similar to that in each of the examples described previously. Moreover, the relation between a thickness of a ball hitting portion in face portion 3 and a thickness in a region other than the ball hitting portion in face portion 3 is the same as that of the case shown in FIG. 1 and so on.

Now, a method of manufacturing the iron heads shown in FIGS. 18 and 19 will be described using FIG. 20.

First, a head portion 1 body with integrated hosel and face is produced by subjecting a bar having a circular cross section to forging process. At this time, a cavity portion 2 is made as wide as possible. Particularly, the width of the peripheral portion on sole portion 4 side is made narrow.

A planar portion 25 is formed by forming this peripheral portion to be flat during forging or by post-processing such as machining. In addition, during the forging or the machining, projections (projected portions) or recess portions are provided to planar portion 25 in plurality of locations. In the example shown in FIG. 20, projected portions 21 are formed in three locations. A smooth curved surface portion may be provided instead of planar portion 25. In this case, a curved surface portion having a shape that fits the above curved surface portion should be provided on back part 20 side as well.

On the other hand, back part 20 is formed in a separate step using a material having a larger specific gravity than that of the material of the head portion 1 body. Back part 20 can also be produced by forging and the like. Back part 20 is provided with recess portions or projections (projected portions) in locations that correspond to the projections (projected portions) or recess portions provided in planar portion 25. In the example shown in FIG. 20, recess portions 22 are formed in three locations.

In back part 20 having the above-described structure, the portion that is to abut against planar portion 25 is made flat to form a planar portion. The planar portion and recess portions 22, also, can be formed by forging, machining and so on. Then, the planar portion is superposed to planar portion 25 on the head portion 1 body, and projected portions 21 are press-fitted into recess portions 22.

Thus, as shown in FIG. 19, the head portion 1 body and back part 20 can be integrated, and head portion 1 having groove 6 having an undercut-shape behind face portion 3 can be produced.

Next, a golf club set according to the present invention will be described.

Figure 21A:
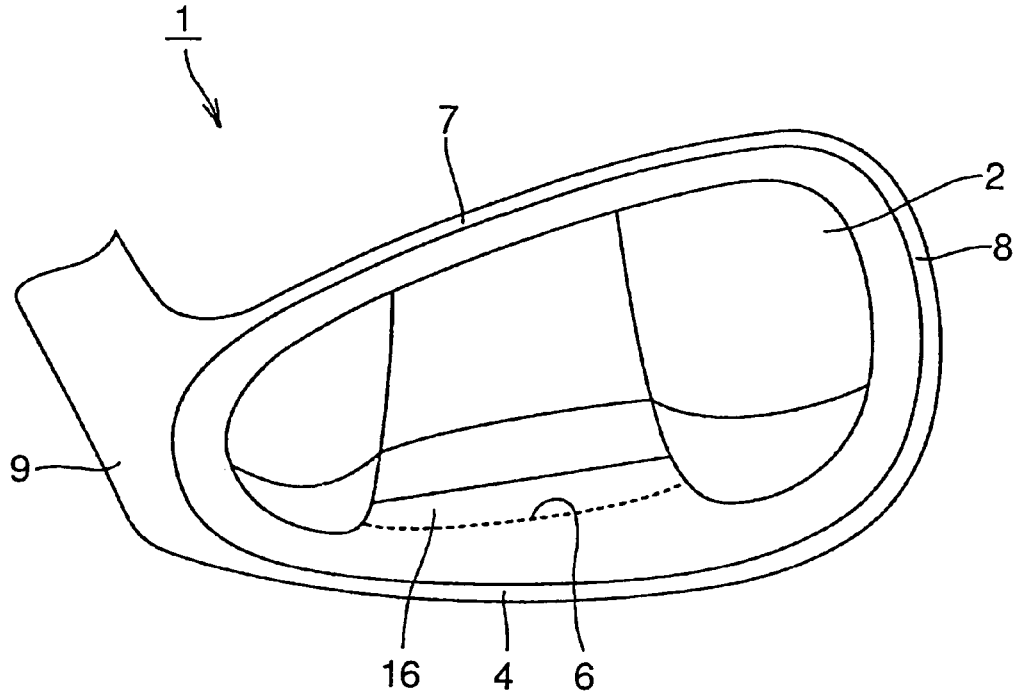
FIG. 21A is a rear view of a head portion in a short iron golf club according to the present invention.
Figure 21B:
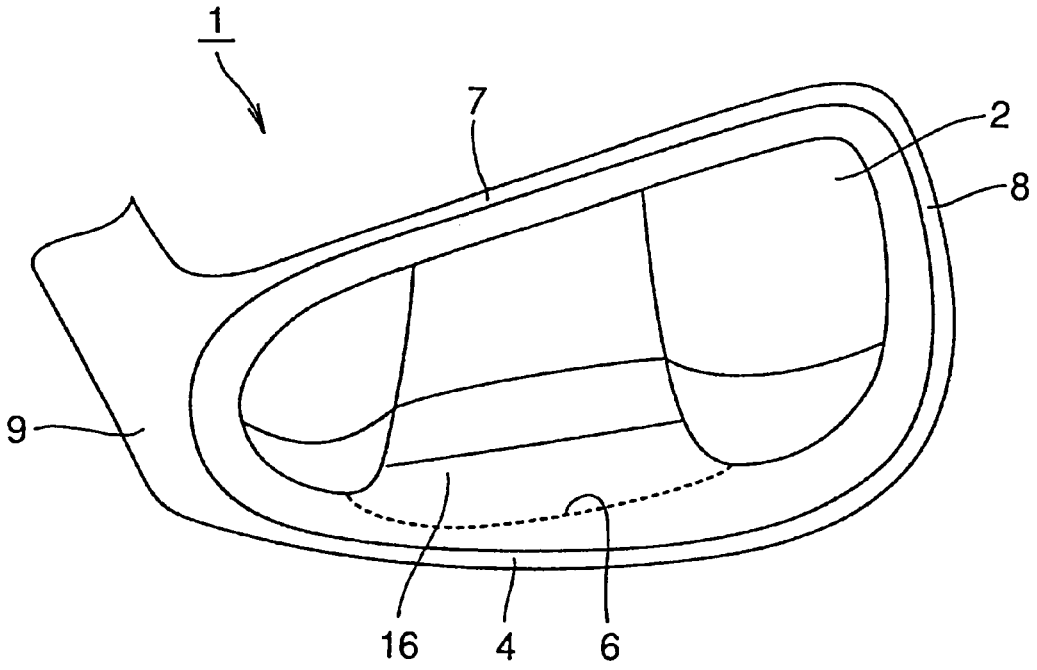
FIG. 21B is a rear view of a head portion in a long iron golf club according to the present invention.

The golf club set according to the present invention is includes a long iron golf club (for instance, No. 1 to No. 4 iron golf clubs) shown in FIG. 21B, a middle iron golf club (for instance, No. 5 to No. 7 iron golf clubs) shown in FIG. 1 and such, and a short iron golf club (for instance, No. 8 iron golf club to a sand wedge) shown in FIG. 21A.

Each of the long iron golf club, the middle iron golf club, and the short iron golf club is provided with a head portion 1 having a cavity portion 2, a face portion 3, and a sole portion 4, and is provided with a groove 6 on a surface on the cavity portion 2 side of sole portion 4.

In the long iron golf club, a height H of a base surface in a face center portion of groove 6 provided is 8 mm and a depth D thereof is 11 mm, for instance. In the middle iron golf club, a height H of a base surface in a face center portion of groove 6 provided is 13 mm and a depth D thereof is 7 mm, for instance. In the short iron golf club, a height H of a base surface in a face center portion of groove 6 provided is 13 mm and a depth D thereof is 6 mm, for instance.

Figure 22A:
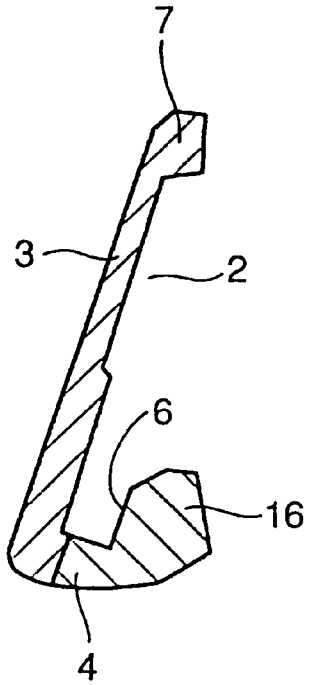
FIGS. 22A to 22C are cross sectional views of head portions in a long iron golf club, a middle iron golf club, and a short iron golf club, respectively.
Figure 22B:
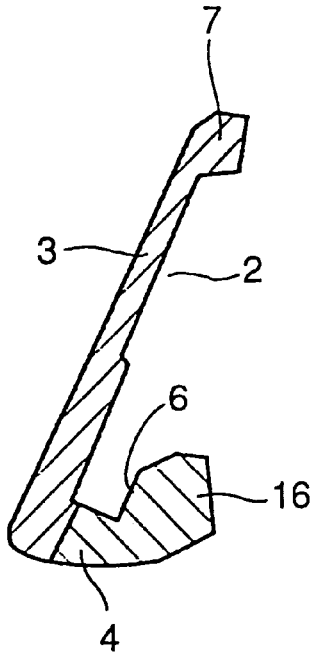
Figure 22C:
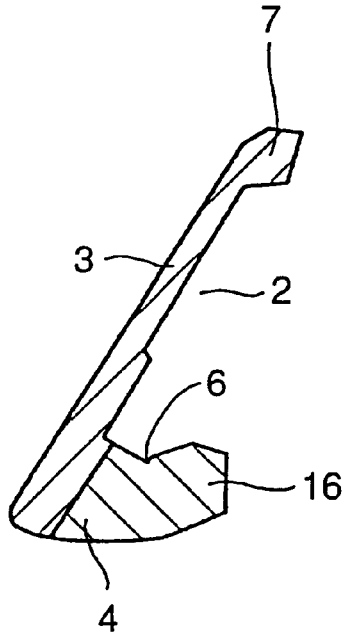
Figure 23:
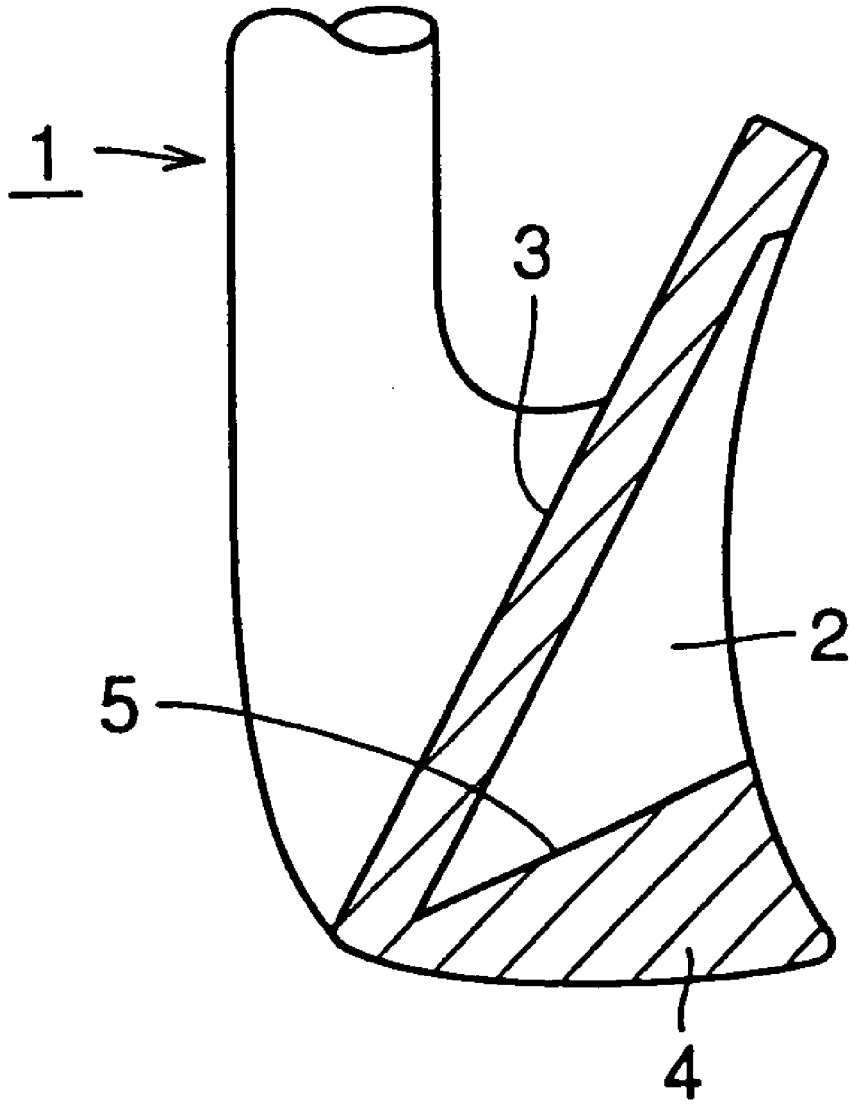
FIG.23 PRIOR ART
FIG. 23 is a cross sectional view of a head portion in a conventional cavity iron.

Accordingly, as shown in FIGS. 22A to 22C, depth D in the face center portion of groove 6 provided in the long iron golf club (FIG. 22A) is greater than depth D in the face center portion of groove 6 provided in the middle iron golf club (FIG. 22B), and depth D in the face center portion of groove 6 provided in the middle iron golf club is greater than depth D in the face center portion of groove 6 provided in the short iron golf club (FIG. 22C).

As described above, by gradually making the depth of groove 6 provided in sole portion 4 deeper from a short iron golf club to a long iron golf club, the effective face lengths of the short iron golf club, the middle iron club, and the long iron golf club can be optimized.

In addition, groove 6 may be provided on a surface on cavity portion 2 side of sole portion 4 of each of the long iron golf club and the middle iron golf club, and depth D of groove 6 in the face center portion of the long iron golf club may be made greater than depth D of groove 6 in the face center portion of the middle iron golf club, while groove 6 is not provided on a surface on cavity portion 2 side of sole portion 4 of the short iron golf club. In this case, also, the same effects as those obtained in the case described above can be achieved.

According to the iron golf club of the present invention described above, the restitution property of the entire face portion can be improved so that the carry can be ensured even upon an offset strike, and too great a reduction in the carry upon the offset strike can be prevented. In addition, the iron golf club head according to the present invention has a cavity portion and a groove so that the head portion can be reduced in weight while the centroid depth can be deepened.

Thus, according to the iron golf club of the present invention, too great a reduction in the carry upon the offset strike can be prevented, while a lighter weight is achieved and the centroid depth is deepened.

According to the golf club set of the present invention, the effective face length can be lengthened and a higher restitution property of the face portion can be achieved in a long iron golf club of which improved carry is demanded, the restitution property of the face portion can be improved while the directivity of the hit ball is ensured in a middle iron golf club, and the directivity of the hit ball is improved in a short iron golf club of which is demanded that a shot that drops the ball near the pin be produced, which together provide a golf club set that has iron golf clubs with performances that match their characteristics.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf club set including a long iron golf club, a middle iron golf club, and a short iron golf club, wherein each of said long iron golf club, said middle iron golf club, and said short iron golf club is provided with a head portion having a cavity portion, a face portion, and a sole portion, a groove extending along said face portion is provided on a surface on said cavity portion side of said sole portion of each of said long iron golf club and said middle iron golf club, and wherein a depth of said groove in a center portion of said face portion of said long iron golf club is greater than a depth of said groove in a center portion of said face portion of said middle iron golf club, and said groove in not provided on a surface on said cavity portion side of said sole portion of said short iron golf club.

2. An iron golf club provided with a head portion having a cavity portion, a face portion, and a sole portion, wherein a groove extending along a ball hitting portion of said face portion is provided on a surface on said cavity portion side of said sole portion, wherein height of a base surface of said groove from a base surface of said sole portion is made lower on said heel portion side than on said toe portion side; and a thickness of the ball hitting portion in said face portion is made greater than a thickness of a top edge side portion of said face portion located between said ball hitting portion and a top edge portion and at least as thick as a thickness of a sole side portion of said face portion that is located between said ball hitting portion and said sole portion and that extends along said groove.

3. The iron golf club according to claim 2, wherein the thickness of said ball hitting portion is made greater than a thickness of a toe side portion of said face portion located between a toe portion of said head portion and said ball hitting portion and greater than a thickness of a heel side portion of said face portion located between a heel portion of said head portion and said ball hitting portion.

4. The iron golf club according to claim 2, wherein said toe side portion includes a first region located on said top edge portion side and a second region located on said sole portion side, said heel side portion includes a third region located on said top edge portion side and a fourth region located on said sole portion side, and a thickness of said first region is made smaller that a thickness of said second region, and a thickness of said third region is made smaller that a thickness of said fourth region.

5. The iron golf club according to claim 2, wherein said sole portion includes a projected wall portion that defines one of side wails of said groove and that rises along said face portion toward said top edge portion.

6. The iron golf club according to claim 2, wherein said head portion is formed by forging.

* * * * *